US009268277B2

(12) United States Patent
Sone

(10) Patent No.: US 9,268,277 B2
(45) Date of Patent: Feb. 23, 2016

(54) IMAGE FORMING APPARATUS AND CAUSAL PART DETERMINATION METHOD

(71) Applicant: Konica Minolta, Inc., Tokyo (JP)

(72) Inventor: Shintaro Sone, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/589,436

(22) Filed: Jan. 5, 2015

(65) Prior Publication Data

US 2015/0192884 A1 Jul. 9, 2015

(30) Foreign Application Priority Data

Jan. 9, 2014 (JP) ..... 2014-002361

(51) Int. Cl.

| | |
|---|---|
| ***G03G 15/00*** | (2006.01) |
| ***G03G 21/00*** | (2006.01) |
| *G03G 15/02* | (2006.01) |
| *G03G 15/06* | (2006.01) |

(52) U.S. Cl.

CPC ..... *G03G 15/50* (2013.01); *G03G 15/5058* (2013.01); *G03G 15/55* (2013.01); *G03G 15/0266* (2013.01); *G03G 15/065* (2013.01)

(58) Field of Classification Search

CPC ..... G03G 15/50; G03G 15/5041; G03G 15/5054; G03G 15/5058; G03G 15/55

USPC ..... 399/9, 31, 49, 72

See application file for complete search history.

(56) References Cited

U.S. PATENT DOCUMENTS 5,995,775 A * 11/1999 Budnik et al. ..... 399/31

FOREIGN PATENT DOCUMENTS

| | | | |
|---|---|---|---|
| JP | 06-003911 | | 1/1994 |
| JP | 06-262800 | A | 9/1994 |
| JP | H07191580 | A | 7/1995 |
| JP | 2005125633 | A | 5/2005 |
| JP | 2005-254491 | A | 9/2005 |
| JP | 2009-063810 | A | 3/2009 |
| JP | 2013166374 | A | 8/2013 |

OTHER PUBLICATIONS

Machine translation of JP 06-003911 (publication date of Jan. 14, 1994) printed on Jun. 23, 2015.*

Office Action of corresponding Japanese application including English abstract cover page dated Jan. 5, 2016.

* cited by examiner

*Primary Examiner* — Sophia S Chen

(74) *Attorney, Agent, or Firm* — Lucas & Mercanti, LLP

(57) ABSTRACT

An image forming apparatus includes: an image forming section configured to form a predetermined test image on an image bearing member by a regular development scheme and a first bias development scheme; a concentration detection section configured to detect a concentration of the test image formed by the image forming section; and a causal part determination section configured to determine on a basis of a result of detection by the concentration detection section a causal part of an image defect that is caused when an image is output.

12 Claims, 7 Drawing Sheets

| TEST IMAGE / CAUSAL PART | FIRST TEST IMAGE (REGULAR DEVELOPMENT, CHARGING ON, EXPOSING ON) | SECOND TEST IMAGE (FIRST BIAS DEVELOPMENT, CHARGING ON, EXPOSING OFF) | THIRD TEST IMAGE (SECOND BIAS DEVELOPMENT, CHARGING OFF, EXPOSING OFF) |
|---|---|---|---|
| CHARGING DEVICE | BLURRED BLACK STREAK | BLURRED BLACK STREAK (RARELY WHITE STREAK) | NOT FORMED |
| EXPOSING DEVICE | WHITE STREAK | NOT FORMED | NOT FORMED |
| PHOTOCONDUCTOR DRUM | SHARP WHITE STREAK (WIDTH EQUAL TO OR SMALLER THAN 1 [mm]) | SHARP WHITE STREAK (WIDTH EQUAL TO OR SMALLER THAN 1 [mm]) | SHARP WHITE STREAK (WIDTH EQUAL TO OR SMALLER THAN 1 [mm]) |
| DEVELOPING DEVICE | BLURRED WHITE STREAK (WIDTH GREATER THAN 1 [mm]) | BLURRED WHITE STREAK (WIDTH GREATER THAN 1 [mm]) | BLURRED WHITE STREAK (WIDTH GREATER THAN 1 [mm]) |
| INTERMEDIATE TRANSFER BELT | SHARP WHITE STREAK (FORMED AT THE SAME PLACE) | SHARP WHITE STREAK (FORMED AT THE SAME PLACE) | SHARP WHITE STREAK (FORMED AT THE SAME PLACE) |

| TEST IMAGE / CAUSAL PART | FIRST TEST IMAGE (REGULAR DEVELOPMENT, CHARGING ON, EXPOSING ON) | SECOND TEST IMAGE (FIRST BIAS DEVELOPMENT, CHARGING ON, EXPOSING OFF) | THIRD TEST IMAGE (SECOND BIAS DEVELOPMENT, CHARGING OFF, EXPOSING OFF) |
|---|---|---|---|
| CHARGING DEVICE | BLURRED BLACK STREAK | BLURRED BLACK STREAK (RARELY WHITE STREAK) | NOT FORMED |
| EXPOSING DEVICE | WHITE STREAK | NOT FORMED | NOT FORMED |
| PHOTOCONDUCTOR DRUM | SHARP WHITE STREAK (WIDTH EQUAL TO OR SMALLER THAN 1 [mm]) | SHARP WHITE STREAK (WIDTH EQUAL TO OR SMALLER THAN 1 [mm]) | SHARP WHITE STREAK (WIDTH EQUAL TO OR SMALLER THAN 1 [mm]) |
| DEVELOPING DEVICE | BLURRED WHITE STREAK (WIDTH GREATER THAN 1 [mm]) | BLURRED WHITE STREAK (WIDTH GREATER THAN 1 [mm]) | BLURRED WHITE STREAK (WIDTH GREATER THAN 1 [mm]) |
| INTERMEDIATE TRANSFER BELT | SHARP WHITE STREAK (FORMED AT THE SAME PLACE) | SHARP WHITE STREAK (FORMED AT THE SAME PLACE) | SHARP WHITE STREAK (FORMED AT THE SAME PLACE) |

*FIG. 3*

IMAGE FORMING APPARATUS AND CAUSAL PART DETERMINATION METHOD

CROSS REFERENCE TO RELATED APPLICATIONS

This application is entitled and claims the benefit of Japanese Patent Application No. 2014-002361, filed on Jan. 9, 2014, the disclosure of which including the specification, drawings and abstract is incorporated herein by reference in its entirety.

BACKGROUND OF THE INVENTION

1. Field of the Invention

The present invention relates to an image forming apparatus and a causal part determination method.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

A related technique has been proposed in which predetermined test images are produced under different four conditions and the concentrations of the test images are detected, to thereby determine the defective part from the results of the detection. The four conditions include a first condition in which AC voltage application to the charger and light exposure are performed, a second condition in which AC voltage application to the charger is performed but light exposure is not performed, a third condition in which AC voltage application to the charger is not performed but light exposure is performed, and a fourth condition in which AC voltage application to the charger and light exposure are not performed (see, for example, Japanese Patent Application Laid-Open No. 2009-63810).

In addition, a technique has been proposed in which a measured potential on the surface of a photoconductor or a measured concentration of toner attached on the surface of the photoconductor are compared with predetermined conditions, and on the basis of the comparison, the component of the image forming apparatus that requires adjustment is indicated (see, for example, Japanese Patent Application Laid-Open No. 06-262800).

In addition, the degree of image quality problem that is caused when an image is output is determined by using a recording head in which a plurality of recording devices are laid out, and on the basis of the degree thus determined, whether the cause exists in the recording head or in the other processes is determined (see, for example, Japanese Patent Application Laid-Open No. 2005-254491).

As described above, in the above-mentioned image forming apparatuses, an image formed on a sheet through various processes including charging, light exposure, development, transfer, fixing and so forth. Therefore, when an image defect is caused on a sheet on which an image is formed, it is not easy to determine the causal part of the image defect. In particular, the image defect of vertical streaks can be caused in any of the processes, and therefore when vertical streaks are formed, the user or serviceman has to inspect the operating states of the components used in the processes. Therefore, it has been difficult for the user and serviceman to promptly determine and deal with the causal part of the image defect.

SUMMARY OF THE INVENTION

An object of the present invention is to provide an image forming apparatus and a causal part determination method which can promptly determine a image defect causal part.

To achieve the abovementioned object, an image forming apparatus reflecting one aspect of the present invention includes: a charging section to which a charging voltage is applied, the charging section being configured to charge a photoconductor; a light exposure section configured to expose the photoconductor to light to form an electrostatic latent image; a development section to which a development voltage is applied, the development section being configured to develop the electrostatic latent image and form a toner image on the photoconductor; an image forming section configured to form a predetermined test image on an image bearing member by a regular development scheme and a first bias development scheme, the regular development scheme being a scheme in which charging by the charging section to which a first charging voltage is applied, light exposure by the light exposure section and development by the development section to which a first development voltage is applied are performed to form a toner image, the first bias development scheme being a scheme in which charging by the charging section to which a second charging voltage lower than the first charging voltage is applied and development by the development section to which a second development voltage higher than the first development voltage is applied are performed but light exposure by the light exposure section is not performed to form a toner image; a concentration detection section configured to detect a concentration of the test image formed by the image forming section; and a causal part determination section configured to determine on a basis of a result of detection by the concentration detection section a causal part of an image defect that is caused when an image is output.

Desirably, in the image forming apparatus, the causal part determination section extracts a characteristic of a streak image formed on the test image formed by the image forming section, and determines the causal part on a basis of the characteristic of the streak image thus extracted.

Desirably, in the image forming apparatus, the image forming section forms the test image by a second bias development scheme, the second bias development scheme being a scheme in which development by the development section to which a third development voltage lower than the first development voltage is applied is performed but charging by the charging section and light exposure by the light exposure section are not performed to form a toner image.

Desirably, in the image forming apparatus, the causal part determination section determines whether the causal part is the charging section, the light exposure section or an component other than the charging section and the light exposure section.

Desirably, in the image forming apparatus, the image bearing member is an intermediate transfer member, and the causal part determination section determines whether the causal part is the charging section, the light exposure section, the development section, the photoconductor or the intermediate transfer member.

Desirably, the image forming apparatus further includes a reporting section configured to report a causal part determined by the causal part determination section.

A causal part determination method reflecting one aspect of the present invention is used in an image forming apparatus including a charging section to which a charging voltage is applied, the charging section being configured to charge a photoconductor, a light exposure section configured to expose the photoconductor to light to form an electrostatic latent image, and a development section to which a development voltage is applied, the development section being configured to develop the electrostatic latent image and form a toner image on the photoconductor, and includes: forming a predetermined test image on an image bearing member by a regular development scheme and a first bias development scheme, the regular development scheme being a scheme in which charging by the charging section to which a first charging voltage is applied, light exposure by the light exposure section and development by the development section to which a first development voltage is applied are performed to form a toner image, the first bias development scheme being a scheme in which charging by the charging section to which a second charging voltage lower than the first charging voltage is applied and development by the development section to which a second development voltage higher than the first development voltage is applied are performed but light exposure by the light exposure section is not performed to form a toner image; detecting a concentration of a formed test image; and determining on a basis of a result of the detecting a causal part of an image defect that is caused when an image is output.

Desirably, the causal part determination method further includes: extracting a characteristic of a streak image formed on a formed test image; and determining the causal part on a basis of the characteristic of the streak image thus extracted.

Desirably, the causal part determination method further includes forming the test image by a second bias development scheme, the second bias development scheme being a scheme in which development by the development section to which a third development voltage lower than the first development voltage is applied is performed but charging by the charging section and light exposure by the light exposure section are not performed to form a toner image.

Desirably, the causal part determination method further includes determining whether the causal part is the charging section, the light exposure section or an component other than the charging section and the light exposure section.

The causal part determination method according to claim 7 wherein the image bearing member is an intermediate transfer member, and the causal part determination method further comprises determining whether the causal part is the charging section, the light exposure section, the development section, the photoconductor or the intermediate transfer member.

Desirably, the causal part determination method further includes reporting a determined causal part.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 3 is a table showing states of image defects at respective causal parts;

DESCRIPTION OF THE PREFERRED EMBODIMENTS

Figure 1:
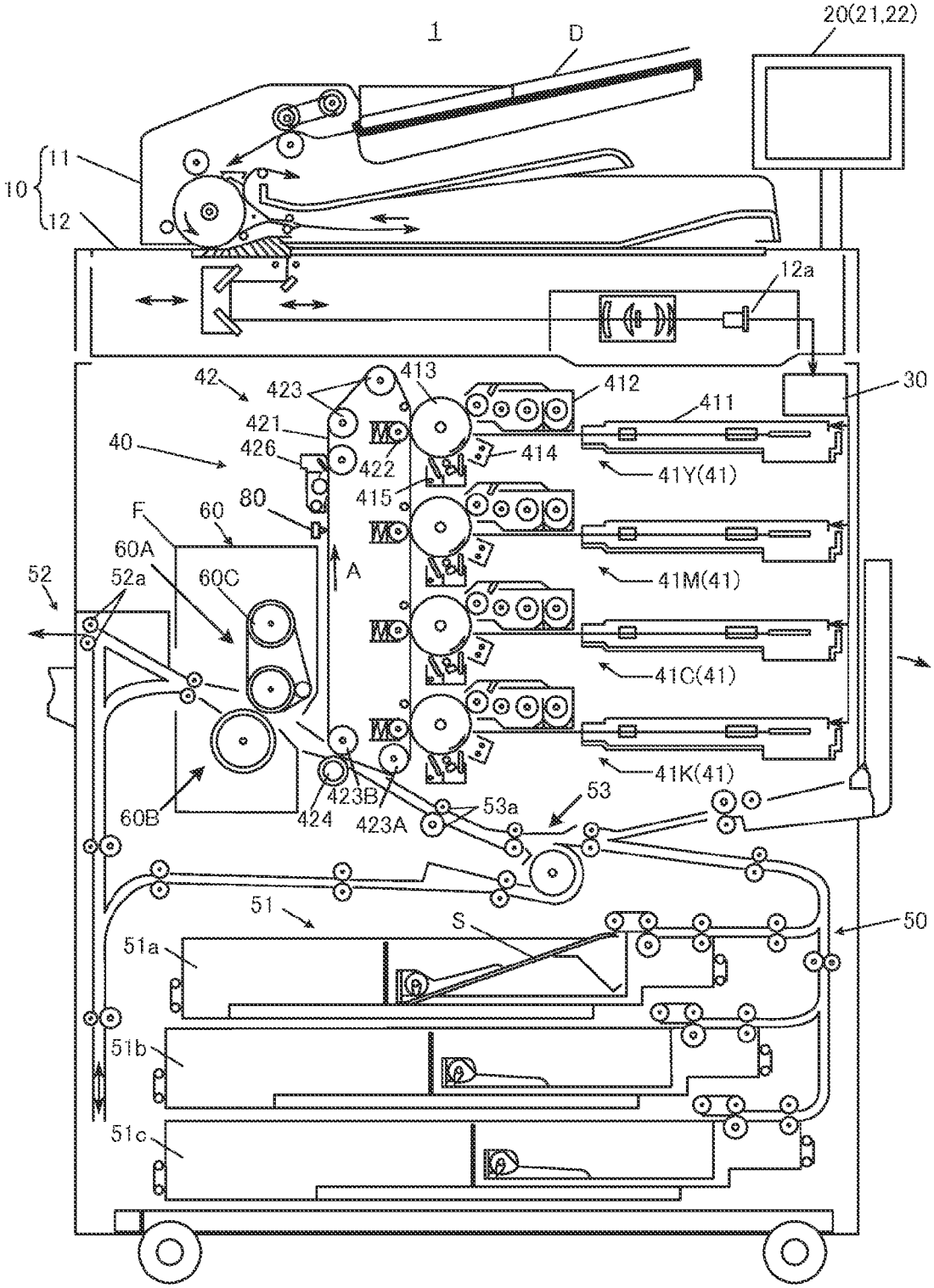
FIG. 1 schematically illustrates a general configuration of an image forming apparatus according to a present embodiment.
Figure 2:
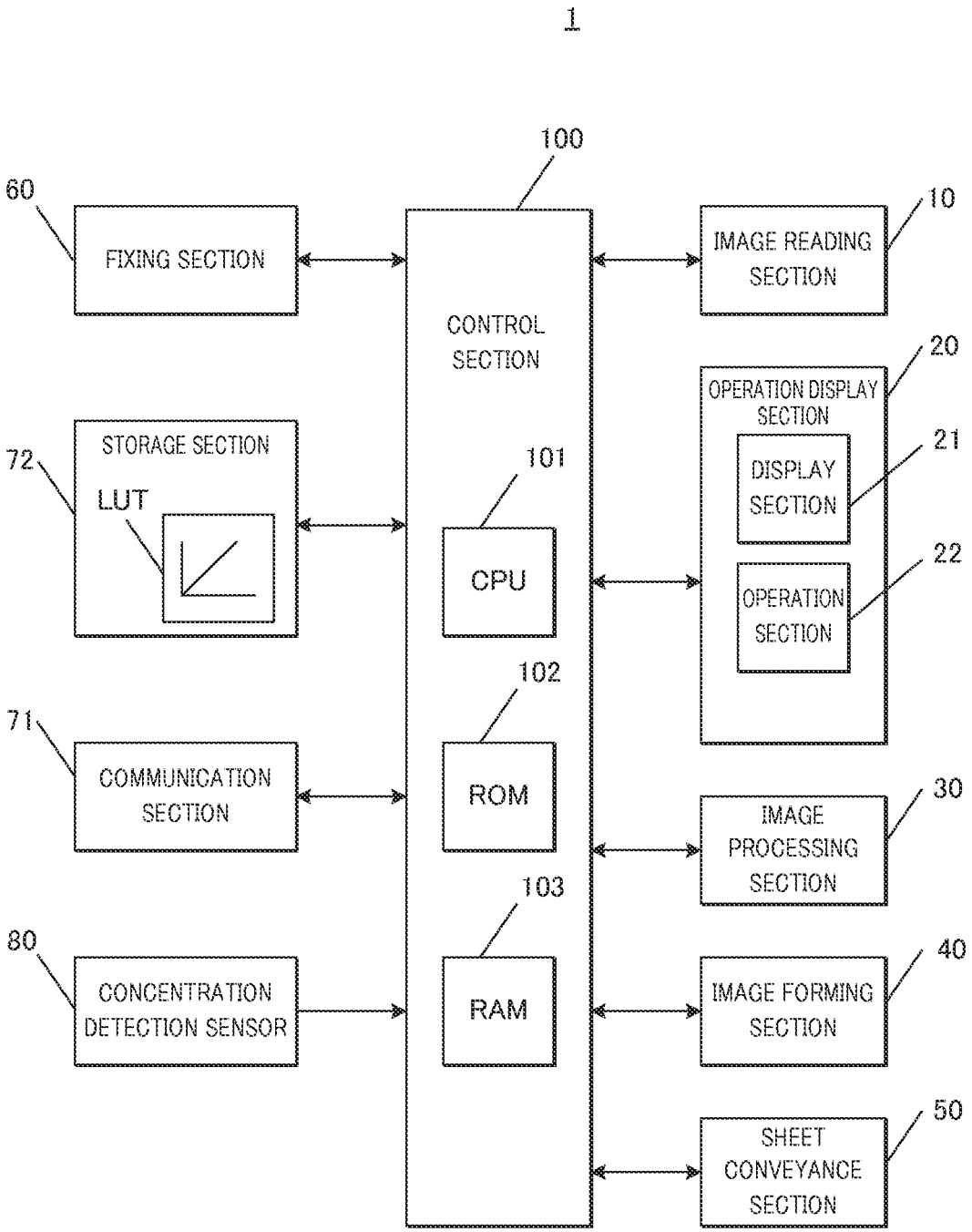
FIG. 2 illustrates a main part of a control system of the image forming apparatus according the present embodiment.

In the following, the present embodiment is described in detail with reference to the drawings. FIG. 1 illustrates an overall configuration of image forming apparatus 1 according to the embodiment of the present invention. FIG. 2 illustrates a principal part of a control system of image forming apparatus 1 according to the embodiment. Image forming apparatus 1 illustrated in FIGS. 1 and 2 is a color image forming apparatus with an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60, concentration detection sensor 80 (which corresponds to "concentration detection section" of the embodiment of the present invention), and control section 100 (which corresponds to "causal part determination section" of the embodiment of the present invention).

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 (which corresponds to"reporting section" of the embodiment of the present invention) and operation section 22. Controls display section 21 to displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposing device 411 (which corresponds to "light exposure section" of the embodiment of the present invention), developing device 412 (which corresponds to "development section" of the embodiment of the present invention), photoconductor drum 413 (which corresponds to "photoconductor" of the embodiment of the present invention), charging device 414 (which corresponds to "charging section" of the embodiment of the present invention), drum cleaning apparatus 415, and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 causes corona discharge to thereby evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. Since the positive charge is formed in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like. intermediate transfer unit 42 intermediate transfer belt 421 (which corresponds to "image bearing member" of the embodiment of the present invention), primary transfer roller 422, a plurality of support roller 423, secondary transfer roller 424, and belt cleaning apparatus 426 the like comprise.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in an arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip (which corresponds to "transfer section" of the embodiment of the present invention) for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet discharging rollers 52*a*.

Concentration detection sensor 80 is arranged at a position on the downstream side of backup roller 423B and on the upstream side of belt cleaning apparatus 426 in the travelling direction of intermediate transfer belt 421, in such a manner as to face the outer peripheral surface of intermediate transfer belt 421. Concentration detection sensor 80 may be a light sensor including a light emitting element such as light-emitting diode (LED), or a photodetector such as a photodiode (PD), for example. Concentration detection sensor 80 irradiates the surface of intermediate transfer belt 421 with light, and detects the amount of returned light (amount of reflected light). It is to be noted that the number of concentration detection sensor 80 and the position where concentration detection sensor 80 is arranged are not limited.

Concentration detection sensor 80 detects the amount of light reflected from the test image formed on the outer peripheral surface of intermediate transfer belt 421 in the main scanning direction of intermediate transfer belt 421, and outputs the amount of the reflected light (concentration) thus detected to control section 100. As the toner adhesion amount of the test image formed on intermediate transfer belt 421 increases, the amount of the applied light blocked by the test image increases, and the amount of light received by the photodetector decreases. As a result, the amount of the reflected light decreases, and the sensor output value output from concentration detection sensor 80 decreases. Conversely, as the toner adhesion amount of the test image formed on intermediate transfer belt 421 decreases, the amount of returned light which has been reflected by intermediate transfer belt 421 increases. As a result, the amount of light received by the photodetector increases, the amount of sensor output value output from concentration detection sensor 80 increases.

In the present embodiment, image forming apparatus 1 determines whether or not a vertical streak image defect (hereinafter also referred to as "streak image") is caused on sheet S on which an image is formed, by using a first test image described later at a predetermined interval (for example, every time when the image formation process has been performed for 10,000 sheets). When it is determined that a streak image is formed, image forming apparatus 1 determines the causal part of the streak image by using a second test image described later, and reports the determined causal part to the user. Examples of the causal part of the streak image include charging device 414, exposing device 411, photoconductor drum 413, developing device 412 and intermediate transfer belt 421.

FIG. 3 is a table showing, for each causal part, states of streak images formed on respective test images (first test image, second test image and third test image) which are formed on intermediate transfer belt 421 under different image formation conditions.

Figure 4A:
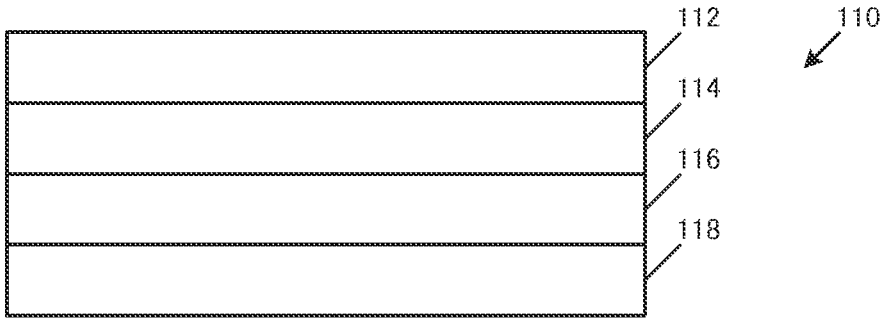
FIGS. 4A to 4C illustrate configurations of test images formed on the outer peripheral surface of an intermediate transfer belt.

The first test image is formed on photoconductor drum 413 by a regular development scheme in which charging by charging device 414 to which a first charging voltage (for example, −800 [V]) is applied, light exposure by exposing device 411 and development by developing device 412 to which a first development voltage (for example, −400 to −600 [V]) is applied are performed to form a toner image, and thereafter, the first test image is transferred to intermediate transfer belt 421. As illustrated in FIG. 4A, first test image 110 includes horizontal belt-shaped halftone image 112 formed by image forming unit 41Y, horizontal belt-shaped halftone image 114 formed by image forming unit 41M, horizontal belt-shaped halftone image 116 formed by image forming unit 41C and horizontal belt-shaped halftone image 118 formed by image forming unit 41K.

Figure 4B:
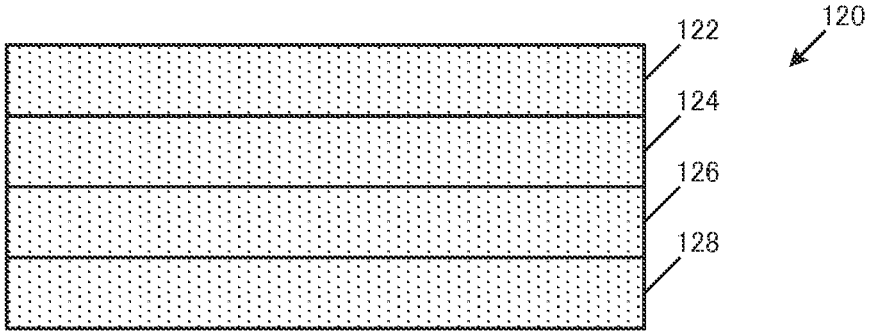

The second test image is formed on photoconductor drum 413 by a first bias development scheme in which charging by charging device 414 to which a second charging voltage (for example, −50 [V]) lower than the first charging voltage is applied and development by developing device 412 to which a second development voltage (for example, −500 to −600 [V]) higher than the first development voltage is applied are performed but light exposure by exposing device 411 is not performed to form a toner image on photoconductor drum 413, and thereafter, the second test image is transferred to intermediate transfer belt 421. As illustrated in FIG. 4B, second test image 120 includes horizontal belt-shaped image 122 formed by image forming unit 41Y, horizontal belt-shaped image 124 formed by image forming unit 41M, horizontal belt-shaped image 126 formed by image forming unit 41C and horizontal belt-shaped image 128 formed by image forming unit 41K.

Figure 4C:
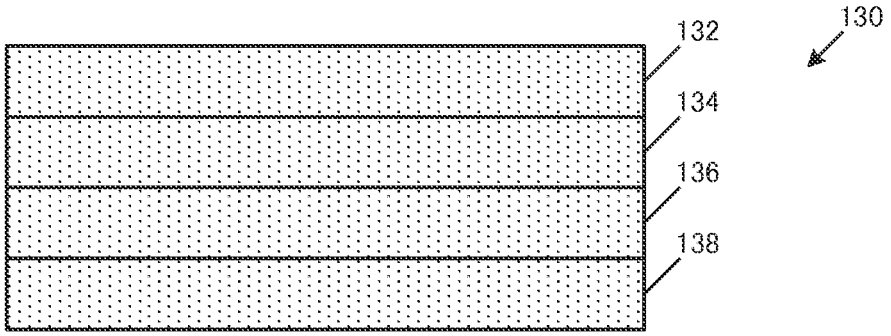

The third test image is formed on photoconductor drum 413 by a second bias development scheme in which development by developing device 412 to which a third development voltage (for example, −150 [V]) lower than the first development voltage is applied is performed but charging by charging device 414 and light exposure by exposing device 411 are not performed to form a toner image, and thereafter, the third test image is transferred to intermediate transfer belt 421. As illustrated in FIG. 4C, third test image 130 includes horizontal belt-shaped image 132 formed by image forming unit 41Y, horizontal belt-shaped image 134 formed by image forming unit 41M, horizontal belt-shaped image 136 formed by image forming unit 41C and horizontal belt-shaped image 138 formed by image forming unit 41K.

As illustrated in FIG. 3, when the causal part of the streak image is charging device 414, a blurred streak image (black streak) is formed on first test image 110. In addition, a blurred streak image (black streak) is formed on second test image 120. It should be noted that, in rare cases, a streak image (white streak) is formed on second test image 120. No streak image is formed on third test image 130.

When the causal part of the streak image is exposing device 411, a streak image (white streak) is formed on first test image 110. No streak image is formed on second test image 120 and third test image 130.

When the causal part of the streak image is photoconductor drum 413, a sharp streak image (white streak) is formed on first test image 110, second test image 120 and third test image 130. The width of the streak image thus formed is equal to or smaller than 1 [mm].

When the causal part of the streak image is developing device 412, a blurred streak image (white streak) is formed on first test image 110, second test image 120 and third test image 130. The width of the streak image thus formed is equal to or greater than 1 [mm]. It is to be noted that the streak image may be obliquely formed, or more specifically, the streak image may be shifted in the main scanning direction of intermediate transfer belt 421.

When the causal part of the streak image is intermediate transfer belt 421, a sharp streak image (white streak) is formed on first test image 110, second test image 120 and third test image 130. In this case, the streak image is formed at the same position in the main scanning direction of intermediate transfer belt 421 on the test images of two or more colors.

As described above, whether or not a streak image is formed and the state of a streak image on the test image differ depending on the causal part of the streak image. In other words, by confirming whether or not a streak image has been formed and the characteristics of the streak image on the test image, the causal part of the streak image can be determined. Control section 100 confirms whether or not a streak image has been formed on the test images formed on intermediate transfer belt 421, on the basis of the concentration detected by concentration detection sensor 80. In addition, when a streak image has been formed, control section 100 extracts the characteristics (color and width) of the streak image on the basis of the concentration detected by concentration detection sensor 80. Whether or not a streak image has been formed is determined as follows, for example.

Regarding the test images, the concentration detected by concentration detection sensor 80 (hereinafter referred to also as "sensor value") each have a constant value around an estimated value. Therefore, when the amplitude of the sensor value (the difference between the maximum value and the minimum value) is equal to or greater than a threshold, or when the sensor value is greater than the range which is estimated from the concentration of the test image, it is determined that a streak image is formed. In addition, when the sensor value is Fourier-transformed and the amount of a high-frequency component contained therein is equal to or greater than a threshold, it can be said that a streak image is formed. The reason for this is that the sensor value normally contains only the direct-current component, but when the streak image is formed, the concentration abruptly varies and thus the alternating-current component (in particular high-frequency component) is contained in the sensor value.

Figure 5:
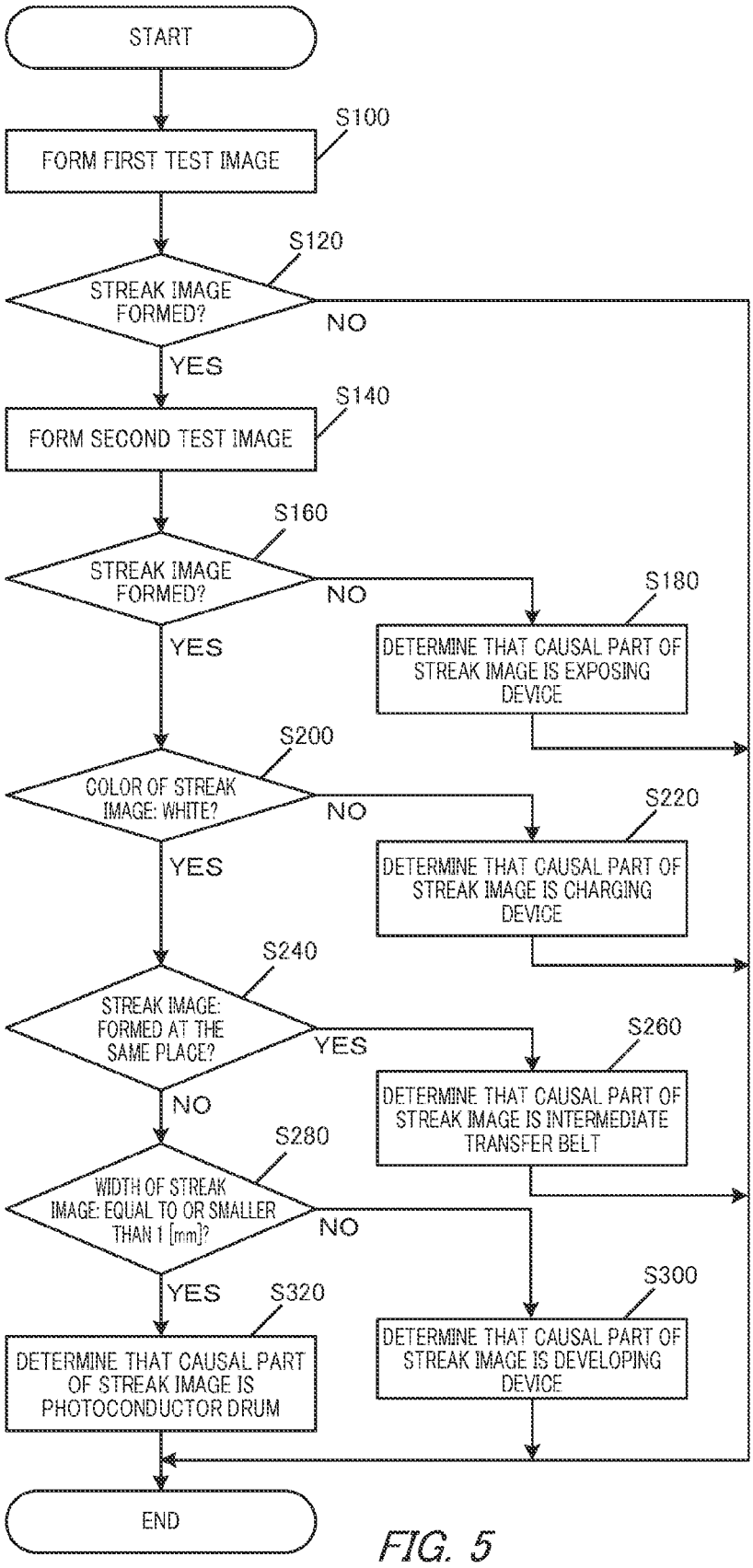
FIG. 5 is a flowchart of a causal part determination operation of the image forming apparatus according to the present embodiment.

Next, a specific operation for determining the causal part of the streak image is described. FIG. 5 is a flowchart of a causal part determination operation of image forming apparatus 1. The processes illustrated in FIG. 5 are performed every time when image forming apparatus 1 performs the image formation process for 10,000 sheets.

First, control section 100 controls image forming section 40 (image forming units 41Y, 41M, 41C, and 41K, and intermediate transfer unit 42) to form first test image 110 on the outer peripheral surface of intermediate transfer belt 421 (step S100). Concentration detection sensor 80 detects the concentration of first test image 110 formed on the outer peripheral surface of intermediate transfer belt 421, and outputs the concentration thus detected to control section 100.

Next, on the basis of the concentration output from concentration detection sensor 80, control section 100 determines whether or not a streak image has been formed on first test image 110 (step S120). When it is determined that a streak image is not formed on first test image 110 (step S120, NO), no vertical streak image defect is caused on sheet S on which image is to be formed, and therefore image forming apparatus 1 terminates the processes of FIG. 5.

Figure 6A:
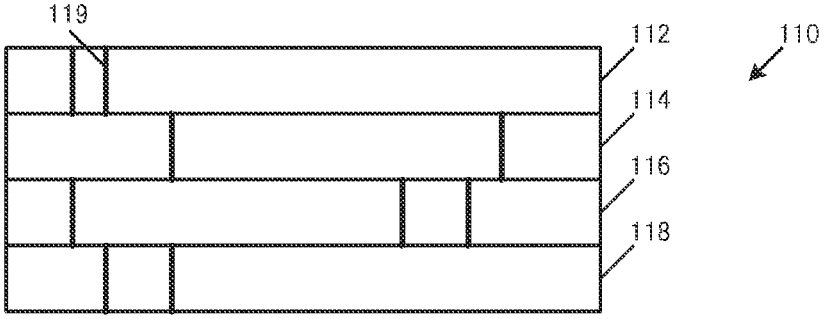
FIGS. 6A to 6E illustrate streak images formed on the test images.

When streak image 119 is formed on first test image 110 (on halftone images 112, 114, 116, and 118, in the example illustrated in FIG. 6A) as illustrated in FIG. 6A (step S120, YES), control section 100 controls image forming section 40 (image forming units 41Y, 41M, 41C, and 41K, and intermediate transfer unit 42) to form second test image 120 on the outer peripheral surface of intermediate transfer belt 421 (step S140). Concentration detection sensor 80 detects the concentration of second test image 120 formed on the outer peripheral surface of intermediate transfer belt 421, and outputs the concentration thus detected to control section 100.

Next, on the basis of the concentration output from concentration detection sensor 80, control section 100 determines whether or not a streak image has been formed on second test image 120 (step S160). When it is determined that no streak image is formed on second test image 120 (step S160, NO), control section 100 determines that the causal part of streak image 119 on first test image 110 is exposing device 411 (step S180). Control section 100 controls display section 21 to display the fact that the causal part of streak image 119 is exposing device 411, so as to facilitate the user or service man to clean up or replace exposing device 411. Upon completion of the process of step S180, image forming apparatus 1 terminates the processes of FIG. 5.

Figure 6B:
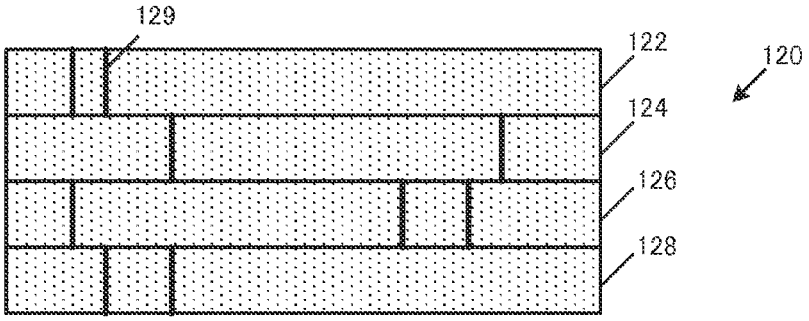

When a streak image 129 is formed on second test image 120 as illustrated in FIG. 6B (step S160, YES), control section 100 determines whether the color of streak image 129 is white or not (step S200). When it is determined that the color of streak image 129 is not white, that is, when it is determined that the color of streak image 129 is black (step S200, NO), control section 100 determines that the causal part of streak image 119 on first test image 110 is charging device 414 (step S220). Control section 100 controls display section 21 to display the fact that the causal part of streak image 119 is charging device 414, so as to facilitate the user or service man to clean up or replace charging device 414. Upon completion of the process of step S220, image forming apparatus 1 terminates the processes of FIG. 5.

Figure 6C:
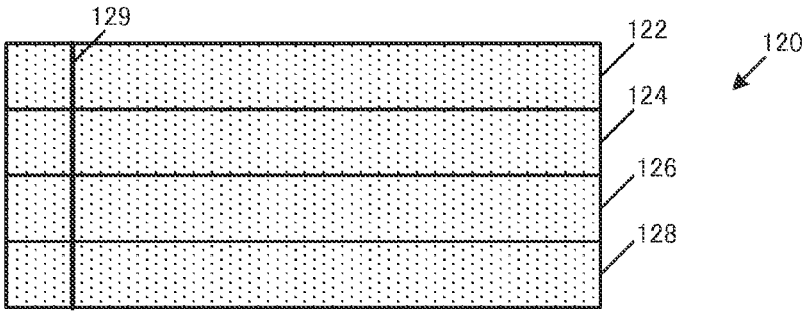

When the color of streak image 129 is white (step S200, YES), control section 100 determines whether or not streak image 129 is formed at the same place in the main scanning direction of intermediate transfer belt 421 on images of two or more colors composing second test image 120 (step S240). When it is determined that streak image 129 is formed at the same place in the main scanning direction of intermediate transfer belt 421 as illustrated in FIG. 6C (step S240, YES), control section 100 determines that the causal part of streak image 119 on first test image 110 is intermediate transfer belt 421 (step S260). Control section 100 controls display section 21 to display the fact that the causal part of streak image 119 is a mark left on intermediate transfer belt 421, so as to facilitate the user or service man to clean up or replace intermediate transfer belt 421. Upon completion of the process of step S260, image forming apparatus 1 terminates the processes of FIG. 5.

Figure 6D:
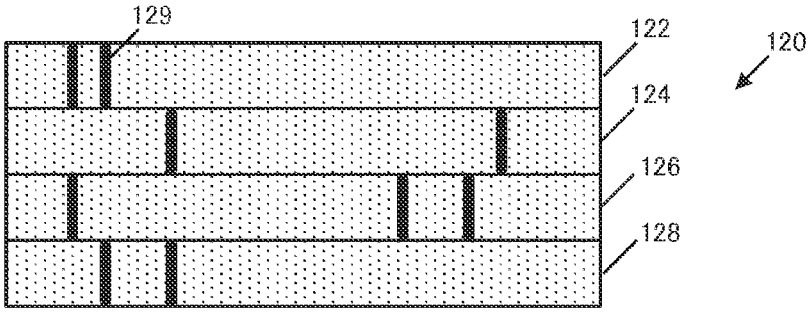

When no streak image 129 is formed at the same place in the main scanning direction of intermediate transfer belt 421 (step S240, NO), control section 100 determines whether or not the width of streak image 129 formed on second test image 120 is not less than 1 [mm] (step S280). When it is determined that the width of streak image 129 is not greater than 1 [mm] as illustrated in FIG. 6D, that is, when it is determined that the width of streak image 129 is greater than 1 [mm] (step S280, NO), control section 100 determines that the causal part of streak image 119 on first test image 110 is developing device 412 (step S300). Control section 100 controls display section 21 to display the fact that the causal part of streak image 119 is developing device 412, so as to facilitate the user or service man to clean up or replace developing device 412. Upon completion of the process of step S300, image forming apparatus 1 terminates the processes of FIG. 5.

When the width of streak image 129 is equal to or smaller than 1 [mm] (step S280, YES), control section 100 determines that the causal part of streak image 119 on first test image 110 is photoconductor drum 413 (step S320). Control section 100 controls display section 21 to display the fact that the causal part of streak image 119 is a mark left on photoconductor drum 413, so as to facilitate the user or service man to clean up or replace photoconductor drum 413. Upon completion of the process of step S320, image forming apparatus 1 terminates the processes of FIG. 5.

Streak image 119 formed at developing device 412 is caused when packing of foreign matters occurs on a developing roller provided in developing device 412. Carrier is not supplied to the place where packing of foreign matters has occurred, and thus toner is not supplied to photoconductor drum 413. In addition, since magnetic carrier is used in developing device 412, sharp (narrow) streak image 119 is not formed even when packing of foreign matters occurs on developing roller. Accordingly, by detecting the width of streak image 119, it is possible to determine whether the causal part of streak image 119 is photoconductor drum 413 or developing device 412.

Figure 6E:
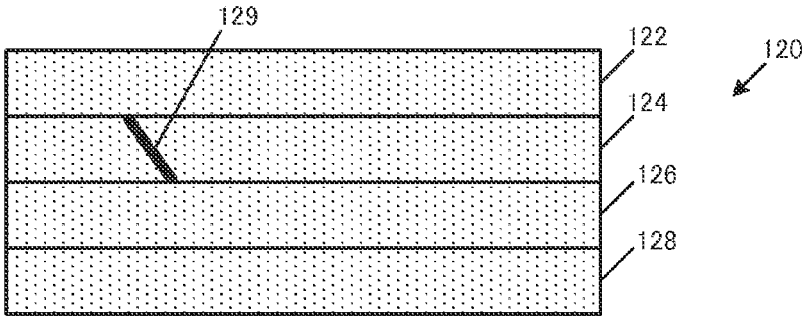

As has been described with reference to FIG. 3, when the causal part of streak image 119 is developing device 412, streak image 129 may be obliquely formed on second test image 120, or more specifically, may be shifted in the main scanning direction of intermediate transfer belt 421 as illustrated in FIG. 6E. In this case, it is possible to determine that the causal part of streak image 119 on first test image 110 is developing device 412 or not by detecting that streak image 129 is obliquely formed on second test image 120. In this case, it is also possible to determine whether the causal part of streak image 129 is developing device 412 by forming a plurality of second test images 120 on intermediate transfer belt 421 and then confirming whether streak image 129 is shifted on the second test images 120 in the main scanning direction of intermediate transfer belt 421.

In addition, in the case where the causal part of streak image 119 on first test image 110 is determined and the degree of streak image 119 is not significant, control section 100 may perform various kinds of correction processes on image data for image formation so as not to form streak image 119.

A cleaning device may be provided to the causal parts of streak image 119 on first test image 110 where a cleaning device can be provided (such as charging device 414 and exposing device 411). In this case, when the causal part of streak image 119 on first test image 110 is, for example, charging device 414 or exposing device 411, it is possible to automatically perform a cleaning process using the cleaning device.

In addition, when the causal part of streak image 119 is charging device 414, the causal part determination operation of image forming apparatus 1 may be changed in consideration of rare cases where a streak image (white streak) may be formed on second test image 120. For example, in the case where 90 [%] of the charging wire used in charging device 414 is contaminated and the remaining part of the charging wire is not contaminated, or in the case where a charging roller is used in charging device 414, a streak image (white streak) may possibly be formed on second test image 120.

Figure 7:
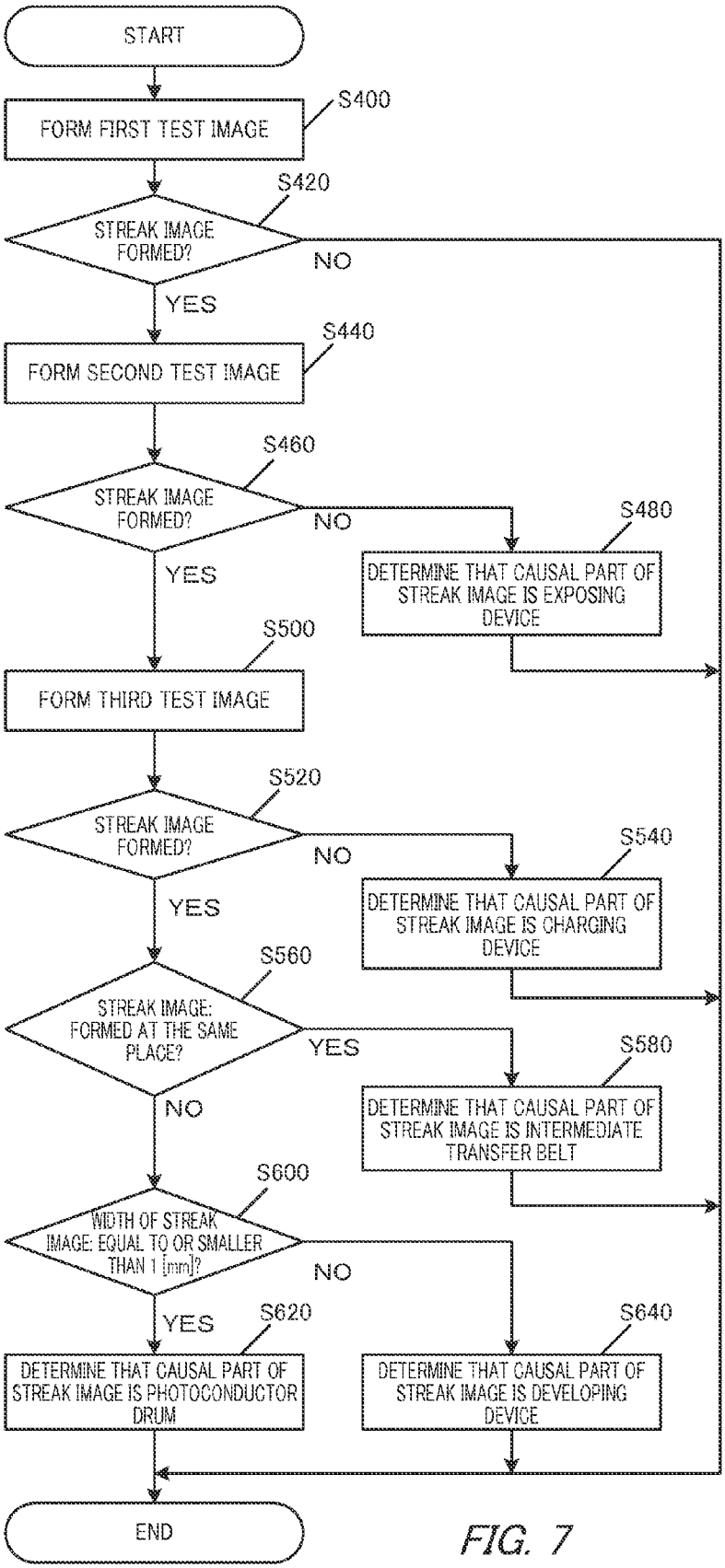
FIG. 7 is a flowchart of a causal part determination operation of the image forming apparatus according to the present embodiment.

FIG. 7 is a flowchart of a causal part determination operation of image forming apparatus 1 performed after the change. The processes in steps S400 to S480 and S560 to S640 are same as steps S100 to S180 and S240 to S300 in FIG. 5, and therefore the description thereof is omitted.

In the determination process at step S460, when a streak image 129 is formed on second test image 120 (step S460, YES), control section 100 controls image forming section 40 (image forming units 41Y, 41M, 41C, and 41K, and intermediate transfer unit 42) to form third test image 130 on the outer peripheral surface of intermediate transfer belt 421 (step S500). Concentration detection sensor 80 detects the concentration of third test image 130 formed on the outer peripheral surface of intermediate transfer belt 421 and outputs the concentration thus detected to control section 100.

Next, on the basis of the concentration output from detection sensor 80, control section 100 determines whether or not a streak image is formed on third test image 130 (step S520). When it is determined that no streak image is formed on third test image 130 (step S520, NO), control section 100 determines that the causal part of streak image 119 on first test image 110 is charging device 414 (step S540). Control section 100 controls display section 21 to display the fact that the causal part of streak image 119 is charging device 414, so as to facilitate the user or service man to clean up or replace charging device 414. Upon completion of the process of step S540, image forming apparatus 1 terminates the processes of FIG. 7.

As has been described in detail, in image forming apparatus 1 of the present embodiment, predetermined test images are formed on photoconductor drum 413 by the regular development scheme and the first bias development scheme and then transferred to intermediate transfer belt 421. Here, the regular development scheme is a scheme in which charging by charging device 414 to which a first charging voltage is applied, light exposure by exposing device 411 and development by developing device 412 to which a first development voltage is applied are performed to form a toner image, and the first bias development scheme is a scheme in which charging by charging device 414 to which a second charging voltage lower than the first charging voltage is applied and development by developing device 412 to which a second development voltage higher than the first development voltage is applied are performed but light exposure by exposing device 411 is not performed to form a toner image. On the basis of the concentration of the test image detected by concentration detection sensor 80, control section 100 determines the causal part of the image defect (streak image) which is caused when the image is output.

According to the above-mentioned configuration of the present embodiment, when an image defect is caused on sheet S, the causal part of the image defect is automatically determined on the basis of the detected concentration of the test images formed by different development schemes. That is, the user or service man can promptly determine the causal part of the image defect without confirming the operation states of the components used in the electrophotographic processes.

It is to be noted that, in the above-mentioned embodiment, concentration detection sensor 80 may be so arranged as to face the outer peripheral surface of photoconductor drum 413 (which corresponds to "image bearing member" of the embodiment of the present invention), not the outer peripheral surface of intermediate transfer belt 421. In this case, concentration detection sensor 80 detects the concentrations of the test images (first test image 110, second test image 120, and third test image 130) formed on photoconductor drum 413, and outputs the concentrations thus detected to control section 100. On the basis of the results of detection by concentration detection sensor 80, control section 100 determines the causal part (charging device 414, exposing device 411, photoconductor drum 413 or developing device 412) of the image defect (streak image) caused when an image is output.

In addition, in the above-mentioned embodiment, at the time of the causal part determination operation, it is possible to inspect the causal part determined by the last causal part determination operation for streak image 129 in priority to the other components. For example, when the causal part determined by the last causal part determination operation is intermediate transfer belt 421, control section 100 at first determines whether or not streak image 129 is formed at the same place in the main scanning direction of intermediate transfer belt 421 on images of two or more colors composing second test image 120. By prioritizing the causal parts of streak image 129 in advance, the time required for the causal part determination operation can be reduced, and consequently the productivity of image formation process can be improved.

In addition, in the above-mentioned embodiment, it is possible to inspect for streak image 129 the component, in priority to the other components, whose operation period is longest among the components that may be a causal part of a streak image, namely, charging device 414, exposing device 411, photoconductor drum 413, developing device 412 and intermediate transfer belt 421. The reason for this is that, as the operation period of the component increases, the load on the component increases and thus the possibility of formation of the streak image at the component increases. For example, when charging device 414 is at an end stage of its operation period, charging device 414 is inspected in priority to the other components to determine whether the color of streak image 129 formed on second test image 120 is black or not. By prioritizing the causal parts of streak image 129 in advance, the time required for the causal part determination operation can be reduced, and consequently the productivity of image formation process can be improved.

In addition, in the above-mentioned embodiment, in the case where image forming apparatus 1 includes a secondary transfer belt for transferring toner on intermediate transfer belt 421 to sheet S, concentration detection sensor 80 may be so arranged as to face the outer peripheral surface of the secondary transfer belt. In this case, concentration detection sensor 80 detects the concentrations of test images (first test image 110, second test image 120, and third test image 130) transferred to intermediate transfer belt 421 and the secondary transfer belt, and outputs the concentrations thus detected to control section 100. Control section 100 determines whether or not streak image 129 is formed at the same place in the main scanning direction of intermediate transfer belt 421 on images of two or more colors composing second test image 120 transferred to intermediate transfer belt 421. When streak image 129 is formed at the same place in the main scanning direction of intermediate transfer belt 421, control section 100 determines that the causal part of streak image 119 on first test image 110 is intermediate transfer belt 421.

When streak image 129 is not formed at the same place in the main scanning direction of intermediate transfer belt 421, control section 100 determines whether or not streak image 129 is formed at the same place in the secondary transfer belt main scanning direction on the images of two or more colors composing second test image 120 transferred on the secondary transfer belt. When streak image 129 is formed at the same place in the main scanning direction of secondary transfer belt, control section 100 determines that the causal part of streak image 119 on first test image 110 is the secondary transfer belt. When streak image 129 is not formed at the same place in the secondary transfer belt main scanning direction, control section 100 determines that the causal part of streak image 119 on first test image 110 is fixing section 60.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The invention claimed is:

1. An image forming apparatus comprising:

a charging section to which a charging voltage is applied, the charging section being configured to charge a photoconductor;

a light exposure section configured to expose the photoconductor to light to form an electrostatic latent image;

a development section to which a development voltage is applied, the development section being configured to develop the electrostatic latent image and form a toner image on the photoconductor;

an image forming section configured to form a first test image on an image bearing member by a regular development scheme and a second test image on the image bearing member by a first bias development scheme, the regular development scheme being a scheme in which charging by the charging section to which a first charging voltage is applied, light exposure by the light exposure section and development by the development section to which a first development voltage is applied are performed to form a toner image, the first bias development scheme being a scheme in which charging by the charging section to which a second charging voltage lower than the first charging voltage is applied and development by the development section to which a second development voltage higher than the first development voltage is applied are performed but light exposure by the light exposure section is not performed to form a toner image;

a concentration detection section configured to detect a concentration of the first test image and the second test image formed by the image forming section; and a causal part determination section configured to determine on a basis of a result of detection by the concentration detection section a causal part of an image defect that is caused when an image is output.

2. The image forming apparatus according to claim 1, wherein the causal part determination section extracts a characteristic of a streak image formed on the first test image and the second test image formed by the image forming section, and determines the causal part on a basis of the characteristic of the streak image thus extracted.

3. The image forming apparatus according to claim 1, wherein the image forming section forms a third test image by a second bias development scheme, the second bias development scheme being a scheme in which development by the development section to which a third development voltage lower than the first development voltage is applied is performed but charging by the charging section and light exposure by the light exposure section are not performed to form a toner image.

4. The image forming apparatus according to claim 1, wherein the causal part determination section determines whether the causal part is the charging section, the light exposure section or an component other than the charging section and the light exposure section.

5. The image forming apparatus according to claim 1, wherein the image bearing member is an intermediate transfer member, and the causal part determination section determines whether the causal part is the charging section, the light exposure section, the development section, the photoconductor or the intermediate transfer member.

6. The image forming apparatus according to claim 1 further comprising a reporting section configured to report a causal part determined by the causal part determination section.

7. A causal part determination method in an image forming apparatus including a charging section to which a charging voltage is applied, the charging section being configured to charge a photoconductor, a light exposure section configured to expose the photoconductor to light to form an electrostatic latent image, and a development section to which a development voltage is applied, the development section being configured to develop the electrostatic latent image and form a toner image on the photoconductor, the causal part determination method comprising:

forming a first test image on an image bearing member by a regular development scheme and a second test image on the image bearing member by a first bias development scheme, the regular development scheme being a scheme in which charging by the charging section to which a first charging voltage is applied, light exposure by the light exposure section and development by the development section to which a first development voltage is applied are performed to form a toner image, the first bias development scheme being a scheme in which charging by the charging section to which a second charging voltage lower than the first charging voltage is applied and development by the development section to which a second development voltage higher than the first development voltage is applied are performed but light exposure by the light exposure section is not performed to form a toner image;

detecting a concentration of a formed first test image and formed second test image; and determining on a basis of a result of the detecting a causal part of an image defect that is caused when an image is output.

8. The causal part determination method according to claim 7 further comprising:

extracting a characteristic of a streak image formed on the formed first test image and the formed second test image; and determining the causal part on a basis of the characteristic of the streak image thus extracted.

9. The causal part determination method according to claim 7 further comprising forming a third test image by a second bias development scheme, the second bias development scheme being a scheme in which development by the development section to which a third development voltage lower than the first development voltage is applied is performed but charging by the charging section and light exposure by the light exposure section are not performed to form a toner image.

10. The causal part determination method according to claim 7 further comprising determining whether the causal part is the charging section, the light exposure section or an component other than the charging section and the light exposure section.

11. The causal part determination method according to claim 7, wherein the image bearing member is an intermediate transfer member, and the causal part determination method further comprises determining whether the causal part is the charging section, the light exposure section, the development section, the photoconductor or the intermediate transfer member.

12. The causal part determination method according to claim 7 further comprising reporting a determined causal part.

* * * * *